US007704928B2

(12) United States Patent
Kurosawa et al.

(10) Patent No.: US 7,704,928 B2
(45) Date of Patent: Apr. 27, 2010

(54) LUBRICATING OIL COMPOSITION FOR MANUAL TRANSMISSION

(75) Inventors: Osamu Kurosawa, Yokohama (JP); Masato Takahashi, Yokohama (JP); Toru Matsuoka, Yokohama (JP); Kazuo Yamamori, Nagoya (JP); Koji Saito, Nagoya (JP); Tetuzo Yoneda, Nagoya (JP); Yoshikazu Yamamoto, Nagoya (JP); Akihiko Ichikawa, Nagoya (JP)

(73) Assignees: Nippon Oil Corporation, Tokyo (JP); Toyota Jidosha Kabushiki Kaisha, Aichi (JP)

( * ) Notice: Subject to any disclaimer, the term of this patent is extended or adjusted under 35 U.S.C. 154(b) by 633 days.

(21) Appl. No.: 11/564,523

(22) Filed: Nov. 29, 2006

(65) Prior Publication Data

US 2007/0265175 A1 Nov. 15, 2007

Related U.S. Application Data

(63) Continuation of application No. PCT/JP2005/010298, filed on May 31, 2005.

(30) Foreign Application Priority Data

Jun. 1, 2004 (JP) ..... 2004-163030

(51) Int. Cl.
*C10M 141/10* (2006.01)
*C10M 159/24* (2006.01)
*C10M 135/20* (2006.01)

(52) U.S. Cl. ..... 508/162; 508/372; 508/391; 508/569

(58) Field of Classification Search ..... 508/162, 508/372, 391, 569
See application file for complete search history.

(56) References Cited

U.S. PATENT DOCUMENTS 4,792,410 A * 12/1988 Schwind et al. ..... 508/186
6,245,719 B1 * 6/2001 Kobori ..... 508/110

FOREIGN PATENT DOCUMENTS

| | | | |
|---|---|---|---|
| EP | 1 516 910 | A1 | 3/2005 |
| JP | 09-208976 | A | 8/1997 |
| JP | 11-302679 | A | 11/1999 |
| JP | 2001-311090 | A | 11/2001 |
| JP | 2002-003875 | A | 1/2002 |
| JP | 2003-041283 | A | 2/2003 |
| WO | 2004/003117 | A1 | 1/2004 |

* cited by examiner

*Primary Examiner*—Glenn Caldarola
*Assistant Examiner*—Jim Goloboy
(74) *Attorney, Agent, or Firm*—Panitch Schwarze Belisario & Nadel LLP

(57) ABSTRACT

Provided is a lubricating oil composition for manual transmissions which has anti-seizure properties for shift forks and can provide manual transmissions with excellent shifting characteristics though it has a low viscosity and can save fuel to be used in automobiles. The lubricating oil composition for manual transmissions comprises a lubricating base oil with a kinematic viscosity at 100° C. of 4 to 6 $mm^2/s$, on the basis of the total mass of the composition, (A) 0.14 to 0.20 percent by mass in terms of magnesium of magnesium sulfonate, (B) 0.14 to 0.18 percent by mass in terms of zinc of a specific zinc dithiophosphate, (C) 0.3 to 0.5 percent by mass in terms of sulfur of a sulfur-containing extreme pressure additive other than zinc dithiophosphate, and (D) 0.02 to 0.05 percent by mass in terms of phosphorus of an alkyl phosphite, and having a kinematic viscosity at 40° C. of 25 to 30 $mm^2/s$.

7 Claims, No Drawings

LUBRICATING OIL COMPOSITION FOR MANUAL TRANSMISSION

CROSS-REFERENCE TO RELATED APPLICATIONS

This application is a Continuation of International Application No. PCT/JP2005/010298, filed May 31, 2005, which was published in the Japanese language on Dec. 15, 2005, under International Publication No. WO/2005/118758, the disclosure of which is incorporated herein by reference.

BACKGROUND OF THE INVENTION

The present invention relates to lubricating oil compositions for manual transmissions, particularly to manual transmission lubricating oil compositions with excellent fuel saving properties.

In recent years, energy savings of automobiles, constructions machines, and agricultural machines have been urgently sought as one of the measures for reducing carbon dioxide gas emission from the view point of dealing with environmental issues. Accordingly, lubricating oils used in these machines are required to be more less in stirring resistance and friction resistance than eve before.

Automobile manual transmissions have gear bearing systems. Therefore, the energy saving, i.e., fuel saving of automobiles equipped with such transmissions can be achieved by lowering the viscosity of a transmission lubricating oil because the stirring resistance and friction resistance (friction loss) thereof can be decreased, resulting in an improvement in the power transmission efficiency of the transmissions.

Known lubricating oils for manual transmissions, which have excellent lubricity and low-temperature fluidity, include those with a kinematic viscosity at 40° C. of around 150 $mm^2/s$ (see, for example, Patent Document 1 below). However, such known lubricating oils are too high in stirring resistance and friction resistance to contribute to the improvement of fuel efficiency.

On the other hand, when a lubricating oil for manual transmissions is lowered in viscosity, it is drastically deteriorated in anti-seizure properties. The lubricating oil thus causes seizure of not only the gears and bearings of the transmissions but also of the shift forks which determine the gear ratio upon shifting, possibly resulting in vibrations and defects in, for example, the shifting characteristics. It is considered that anti-seizure properties can be improved with the use of a high-viscosity lubricating oil as disclosed in Patent Document 1 below or addition of an extreme pressure additive. It is known that a polysulfide compound is effective in improving the friction properties between synchronizer rings and gear cones (see, for example, Patent Document 2). However, it is found that a low viscosity lubricating oil raises other problems such as deterioration of its anti-wear properties, in particular for preventing shift forks and synchronizer rings determining the shifting characteristics from wearing and also deterioration of shifting characteristics and synchronizing characteristics, depending on the selection of additives or mutual interaction thereof. It is, therefore, necessary to optimize the selection of base oils, extreme pressure additives, and other additives to be blended.

(1) Patent Document 1: Japanese Patent Laid-Open Publication No. 9-208976

(2) Patent Document 2: Japanese Patent Laid-Open Publication No. 2001-311090

DETAILED DESCRIPTION OF THE INVENTION

The present invention is to provide a lubricating oil composition for manual transmissions which has anti-seizure properties for shift forks and can provide manual transmissions with excellent shifting characteristics though it has a low viscosity. Consequently, the composition can save fuel to be used in automobiles.

As a result of extensive studies conducted by the inventors of the present invention to solve the above-described problems, the present invention was accomplished by finding that a low viscosity lubricating oil composition for manual transmissions comprising a lubricating base oil with a specific viscosity, a specific metallic detergent, a specific zinc dithiophosphate, a sulfur-containing extreme pressure additive, and a specific phosphorus-containing compound, each in a specific amount had extremely excellent anti-seizure properties and was able to allow the transmissions to exhibit excellent shifting characteristics and contribute to fuel saving because of its extremely reduced stirring resistance and friction loss.

That is, the present invention relates to a lubricating oil composition for manual transmissions, comprising a lubricating base oil with a kinematic viscosity at 100° C. of 4 to 6 $mm^2/s$, on the basis of the total mass of the composition, (A) 0.14 to 0.20 percent by mass in terms of magnesium of magnesium sulfonate, (B) 0.14 to 0.18 percent by mass in terms of zinc of zinc dithiophosphate represented by formula (1) below, (C) 0.3 to 0.5 percent by mass in terms of sulfur of a sulfur-containing extreme pressure additive other than zinc dithiophosphate, and (D) 0.02 to 0.05 percent by mass in terms of phosphorus of an alkyl phosphite, and having a kinematic viscosity at 40° C. of 25 to 30 $mm^2/s$:

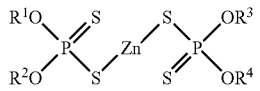

(1)

wherein $R^1$ to $R^4$ are each a secondary alkyl group having 3 or 6 carbon atoms.

Eligible lubricating base oils in the lubricating oil composition for manual transmissions of the present invention (hereinafter also referred to as "lubricating oil composition") include any mineral oils and synthetic oils which have been generally used as base oils for lubricating oils.

Examples of mineral lubricating base oils include paraffinic or naphthenic oils which can be produced by subjecting a lubricating oil fraction produced by atmospheric- or vacuum-distillation of a paraffinic or naphthenic crude oil, to one of or two or more of any suitable combination of refining processes selected from solvent deasphalting, solvent extraction, solvent dewaxing, catalytic dewaxing, hydrocracking, hydrorefining, washing with sulfuric acid, and clay treatment; and n-paraffines. When two or more of the refining processes are combined, they may be conducted in any order or the same refining process may be repeated a plurality of times under different conditions.

Examples of synthetic base oils include, but not limited to, poly-α-olefins such as 1-octene oligomer, 1-decene oligomer and ethylene-propylene oligomer, and/or hydrides thereof; isobutene oligomers and/or hydrides thereof, isoparaffins; alkylbenzenes; alkylnaphthalenes; diesters such as ditridecyl glutarate, di-2-ethylhexyl adipate, diisodecyl adipate, ditridecyl adipate and di-2-ethylhexyl cebacate; polyol esters such as trimethylolpropane caprylate, trimethylolpropane pelargonate, pentaerythritol 2-ethylhexanoate and pentaerythritol pelargonate; polyoxyalkylene glycols; dialkyldiphenyl ethers; polyphenyl ethers; and mixtures of any two or more selected from these oils.

Alternatively, mixtures of any of these mineral oils and any of these synthetic oils at an arbitrary ratio, i.e., semi-synthetic oils are also preferably used.

The lubricating base oil used in the present invention has necessarily a kinematic viscosity at 100° C. of 4 to 6 $mm^2/s$, preferably 4.2 to 5.8 $mm^2/s$, and more preferably 4.5 to 5.5 $mm^2/s$.

A lubricating base oil with a kinematic viscosity at 100° C. of 4 $mm^2/s$ or greater renders it possible to produce a lubricating oil composition which is sufficient in oil film formation leading to excellent lubricity and less in evaporation loss of the base oil under elevated temperature conditions. A lubricating base oil with a kinematic viscosity at 100° C. of 6 $mm^2/s$ or less renders it possible to produce a lubricating oil composition with a small friction resistance (friction loss) at lubricating sites and less stirring resistance due to its small fluid resistance.

Although not restricted, the viscosity index of the lubricating base oil is preferably 90 or greater and more preferably 110 or greater. A lubricating base oil with a viscosity index of 90 or greater renders it possible to produce a lubricating oil composition having both oil film formation capability and fluid or stirring resistance reducing capability.

Although not restricted, the pour point of the lubricating base oil is preferably 0° C. or lower and more preferably −5° C. or lower. A lubricating base oil with a pour point of 0° C. or lower renders it possible to produce a lubricating oil composition which is less preventive of the motion of machines at low temperatures.

Although not restricted, the kinematic viscosity at 40° C. of the lubricating base oil is preferably 18 $mm^2/s$ or greater, more preferably 19 $mm^2/s$ or greater, and further more preferably 21 $mm^2/s$ or greater with the objectives of excellent oil film formation capability, excellent lubricity, and less evaporation loss of the base oil at elevated temperatures. The kinematic viscosity at 40° C. is preferably 33 $mm^2/S$ or less, more preferably 32 $mm^2/s$ or less, and further more preferably 30 $mm^2/s$ or less with the objectives of less friction resistance (friction loss) at lubricating sites and less stirring resistance due to its less fluid resistance.

(A) magnesium sulfonate (hereinafter also referred to as "Component (A)") of the lubricating oil composition of the present invention is desirously an overbased or basic magnesium sulfonate with a base number of preferably 20 to 450 mgKOH/g and more preferably 50 to 400 mgKOH/g. Component (A) with a base number of less than 20 mgKOH/g is not preferable because it can not provide required shifting characteristics, while Component (A) with a base number in excess of 450 mgKOH/g because it is structurally unstable and thus deteriorates the storage stability of the resulting composition. The term "base number" used herein denotes a base number measured by the perchloric acid potentiometric titration method in accordance with section 7 of JIS K2501 "Petroleum products and lubricants-Determination of neutralization number".

Examples of magnesium sulfonate which may be used as Component (A) in the present invention include magnesium salts of alkyl aromatic sulfonic acids produced by sulfonating alkyl aromatic compounds having a molecular weight of 100 to 1500, preferably 200 to 700. Specific examples of the alkyl aromatic sulfonic acids include petroleum sulfonic acids and synthetic sulfonic acids.

Petroleum sulfonic acids may be those produced by sulfonating an alkyl aromatic compound contained in the lubricant fraction of a mineral oil or mahogany acid by-produced upon production of white oil. Synthetic sulfonic acids may be those produced by sulfonating an alkyl benzene having a straight-chain or branched alkyl group, produced as a by-product from a plant for producing an alkyl benzene used as the raw materials of detergents or produced by alkylating a polyolefin to benzene, or those produced by sulfonating an dinonylnaphthalene. Although not restricted, sulfonating agents used for sulfonating these alkyl aromatic compounds may be fuming sulfuric acids and sulfuric acid.

As long as magnesium sulfonate has a base number within the range of 20 to 450 mgKOH/g, it may be a neutral salt (normal salt) produced by reacting an alkyl aromatic sulfonic acid directly with a magnesium base such as an oxide or hydroxide of magnesium or produced by once converting an alkyl aromatic sulfonic acid to an alkali metal salt such as a sodium salt or a potassium salt and then substituting the alkali metal salt with an alkaline earth metal salt; a basic salt produced by heating such a neutral (normal) salt with an excess amount of a magnesium salt or base (magnesium hydroxide or oxide) in the presence of water; or an overbased salt (superbasic salt) produced by reacting such a neutral (normal) salt with a magnesium base in the presence of carbonic acid gas.

These reactions are usually conducted in a solvent (an aliphatic hydrocarbon solvent such as hexane, an aromatic hydrocarbon solvent such as xylene, and light lubricating base oil). Although magnesium sulfonate is usually commercially available as diluted with a light lubricating base oil, it is preferable to use such magnesium sulfonate whose metal content is within the range of 1.0 to 20 percent by mass and preferably 2.0 to 16 percent by mass.

The lubricating oil composition of the present invention contains Component (A) in an amount of necessarily 0.14 to 0.20 percent by mass and preferably 0.16 to 0.18 percent by mass in terms of magnesium on the basis of the total mass of the composition. Component (A) of less than 0.14 percent by mass is not preferable because the resulting composition can not provide requisite shifting characteristics and will be poor in anti-seizure properties for shift forks, while Composition (A) in excess of 0.20 percent by mass is not also preferable because the resulting composition will be deteriorated in oxidation stability.

The use of magnesium sulfonate in the predetermined amount in the lubricating oil composition of the present invention can provide excellent anti-seizure properties for shift forks even though the composition is lowered in viscosity and can maintain excellent shifting characteristics.

Component (B) of the lubricating oil composition of the present invention is zinc dithiophosphate represented by the formula

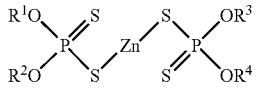

(1)

In formula (1), $R^1$, $R^2$, $R^3$, and $R^4$ are each independently a secondary alkyl group having 3 or 6 carbon atoms. Alternatively, Component (B) may be a mixture of zinc dithiophosphate of formula (1) wherein all $R^1$ to $R^4$ are secondary alkyl groups having 3 carbon atoms and zinc dithiophosphate of formula (1) wherein all $R^1$ to $R^4$ are secondary alkyl groups having 6 carbon atoms, or zinc dithiophosphate of formula (1)

wherein any one of $R^1$ to $R^4$ is a secondary alkyl group having 3 carbon atoms and the others are secondary alkyl groups having 6 carbon atoms. In the present invention, it is particularly preferred that the lubricating oil composition contain zinc dithiophosphate of formula (1) wherein any one of $R^1$ to $R^4$ is a secondary alkyl group having 3 carbon atoms and the others are secondary alkyl groups having 6 carbon atoms with the objective of dissolubility in a lubricating oil and excellent storage stability. Such zinc dithiophosphate may be produced using a mixture of a secondary alcohol having 3 carbon atoms and a secondary alcohol having 6 carbon atoms as a raw material.

The lower limit content of Component (B) in the lubricating oil composition is 0.14 percent by mass and preferably 0.15 percent by mass in terms of zinc on the basis of the total mass of the composition. The upper limit content is 0.18 percent by mass and preferably 0.17 percent by mass in terms of zinc on the basis of the total mass of the composition. Component (B) of less than 0.14 percent by mass in terms of zinc on the basis of the total mass of the composition is ineffective in improving anti-seizure properties. Component (B) in excess of 0.18 percent by mass in terms of zinc on the basis of the total mass of the composition is ineffective in improving anti-seizure properties and also deteriorates the oxidation stability of the resulting lubricating oil composition.

Any known sulfur-containing extreme pressure additive used in lubricating oil other than zinc dithiophosphate may be used as (C) sulfur-containing extreme pressure additive (hereinafter also referred to as "Component (C)) of the lubricating oil composition. Specific examples of Component (C) include compounds selected from the following (C-1) to (C-5) compounds. Among (C-1) to (C-5), (C-4) dihydrocarbyl polysulfide compounds and/or (C-5) sulfurized ester compounds are particularly preferably used in the present invention.

(C-1) thiazole compounds (C-2) thiadiazole compounds (C-3) dithiocarbamate compounds (C-4) dihydrocarbyl polysulfide compounds (C-5) sulfurized ester compounds (C-1) thiazole compounds are preferably compounds represented by formulas (2) and (3):

(2)

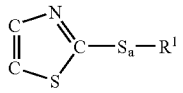

(3)

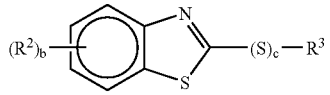

In formulas (2) and (3), $R^1$ and $R^2$ are each independently hydrogen or a hydrocarbon group having 1 to 30 carbon atoms, $R^3$ is an alkyl group having 1 to 4 carbon atoms, and a, b, and C are each independently an integer of 0 to 3.

Examples of the hydrocarbon group having 1 to 30 carbon atoms include alkyl, cycloalkyl, alkylcycloalkyl, alkenyl, aryl, alkylaryl, and arylalkyl groups.

Examples of the alkyl group include straight-chain or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of the cycloalkyl group include those having 5 to 7 carbon atoms, such as cyclopentyl, cyclohexyl, and cycloheptyl groups.

Examples of the alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups, of which the alkyl groups may bond to any position of the cycloalkyl groups.

Examples of the alkenyl group include butenyl, pentenyl, hexenyl, heptenyl, octenyl, noneyl, decenyl, undecenyl, dodecenyl, tridecenyl, tetradecenyl, pentadecenyl, hexadecenyl, heptadecenyl and octadecenyl groups, all of which may be straight-chain or branched and the position of which the double bonds may vary.

Examples of the aryl group include phenyl and naphtyl groups.

Examples of the alkylaryl group include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of the arylalkyl group include those having 7 to 12 carbon atoms, such as benzyl, phenylethyl, phenylpropyl, phenylbutyl, phenylpentyl, and phenylhexyl groups, of which the alkyl groups may be straight-chain or branched.

(C-2) thiadiazole compounds are preferably compounds represented by formulas (4) and (5):

(4)

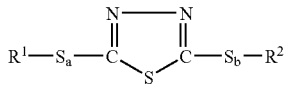

(5)

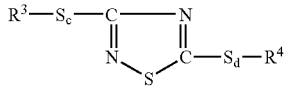

In formulas (4) and (5), $R^1$, $R^2$, $R^3$, and $R^4$ are each independently hydrogen or a hydrocarbon group having 1 to 30 carbon atoms and may be the same or different, and a, b, c, and d are each independently an integer of 0 to 8.

Examples of the hydrocarbon group having 1 to 30 carbon atoms include alkyl, cycloalkyl, alkylcycloalkyl, alkenyl, aryl, alkylaryl, and arylalkyl groups.

Examples of the alkyl group include straight-chain or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of the cycloalkyl group include those having 5 to 7 carbon atoms, such as cyclopentyl, cyclohexyl, and cycloheptyl groups.

Examples of the alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups, of which the alkyl groups may bond to any position of the cycloalkyl groups.

Examples of the alkenyl group include butenyl, pentenyl, hexenyl, heptenyl, octenyl, noneyl, decenyl, undecenyl, dodecenyl, tridecenyl, tetradecenyl, pentadecenyl, hexadecenyl, heptadecenyl and octadecenyl groups, all of which may be straight-chain or branched and the position of which the double bonds may vary.

Examples of the aryl group include phenyl and naphtyl groups.

Examples of the alkylaryl group include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of the arylalkyl group include those having 7 to 12 carbon atoms, such as benzyl, phenylethyl, phenylpropyl, phenylbutyl, phenylpentyl, and phenylhexyl groups, of which the alkyl groups may be straight-chain or branched.

(C-3) dithiocarbamate compounds are preferably compounds represented by formulas (6) and (7):

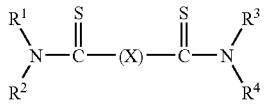

(6)

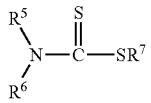

(7)

In formulas (6) and (7), $R^1$, $R^2$, $R^3$, $R^4$, $R^1$, $R^6$, and $R^7$ are each independently a straight-chain or branched alkyl group having 1 to 18 and preferably 1 to 10 carbon atoms and may be the same or different. In formula (6), (X) represents S, S—S, S—$CH_2$—S, S—$(CH_2)_2$—S, S—$(CH_2)_3$—S, or S—Zn—S.

Examples of the alkyl group include methyl, ethyl, propyl, n-butyl, isobutyl, pentyl, isopentyl, hexyl, heptyl, octyl, 2-ethylhexyl, nonyl, decyl, tridecyl, and octadecyl groups. When an alkyl group is introduced, a mixture of α-olefin may be used as a raw material. In this case, an alkylthiocarbamyl compound having a plurality of types of alkyl groups may be used.

Preferred examples of the dithiocarbamate compounds include methylenebis(dibutyldithiocarbamate), bis(dimethylthiocarbamyl)monosulfide, bis(dimethylthiocarbamyl)disulfide, bis(dibutylthiocarbaamyl)disulfide, bis(dipentylthiocarbamyl)disulfide, bis(dioctylthiocarbamyl)disulfide, and zinc dipentyldithiocarbamate.

(C-4) dihydrocarbyl polysulfide compounds are preferably compounds represented by formula (8):

$$R^1\text{-}Sa\text{-}R^2 \quad (8)$$

In formula (8), $R^1$ and $R^2$ are each independently a straight-chain or branched alkyl or alkenyl group having 1 to 22 carbon atoms, or an aryl, alkylaryl or arylalkyl group having 6 to 20 carbon atoms and may be the same or different, and a is an integer of 1 to 5 and preferably 1 or 2. The alkyl group include primary, secondary, and tertiary alkyl groups.

Specific examples for $R^1$ and $R^2$ include methyl, ethyl, propyl, butyl, pentyl, hexyl, heptyl, octyl, nonyl, decyl, dodecyl, cyclohexyl, phenyl, naphthyl, tolyl, xylyl, benzyl, and phenetyl groups.

$R^1$ and $R^2$ are preferably alkyl groups having 3 to 18 carbon atoms derived from propylene or isobutene, or aryl, alkylaryl, or arylalkyl groups having 6 to 8 carbon atoms. Examples of these groups include alkyl groups inclusive of all branched isomers, such as isopropyl, branched hexyl derived from propylene dimmer, branched nonyl derived from propylene trimer, branched dodecyl derived from propylene tetramer, branched pentadecyl derived from propylene pentamer, branched octadecyl derived from propylene hexamer, tert-butyl, branched octyl derived from isobutene dimmer, branched octyl derived from isobutene trimer, and branched hexadecyl derived from isobutene tetramer; aryl groups such as phenyl; alkylaryl groups such as tolyl, ethylphenyl, and xylyl, of which the alkyl groups may be straight-chain or branched and may bond to any position of the aryl groups; and arylalkyl groups such as benzyl and phenylethyl, of which phenyl groups may bond to any position of the alkyl groups.

$R^1$ and $R^2$ are particularly preferably alkyl groups having 3 to 18 carbon atoms derived from propylene or isobutene, and most preferably alkyl groups having 6 to 15 carbon atoms.

Specific examples of the dihydrocarbyl polysulfide compounds include dibutyl polysulfide, dihexyl polysulfide, dioctyl polysulfide, dinonyl polysulfide, didecyl polysulfide, didodecyl polysulfide, ditetradecyl polysulfide, dihexadecyl polysulfide, dioctadecyl polysulifide, dieicosyl polysulfide, diphenyl polysulfide, dibenzyl polysulfide, diphenetyl polysulfide, polypropenyl polysulfide, polybutenyl polysulfide, and mixtures thereof. Among these compounds, particularly preferred are polypropenyl polysulfide, polybutenyl polysulfide, and mixtures thereof. The polypropenyl polysulfide, polybutenyl polysulfide, and mixtures thereof may be produced by sulfurizing an olefinic hydrocarbon such as propylene, isobutene, dimers to tetramers of these monomers, or a mixture of any of these monomers or polymers with an elemental sulfur, halogenated sulfur (for example, sulfur monochloride or sulfur dichloride), hydrogen sulfide, or a mixture thereof.

Examples of (C-5) sulfurized ester compounds include those produced by sulfurizing animal or vegetable fats and oils such as beef tallow, lard, fish oil, rapeseed oil, and soybean oil; unsaturated fatty acid esters produced by reacting unsaturated fatty acids such as oleic acid, linolic acid, and fatty acids extracted from the foregoing animal or vegetable fats and oils with various alcohols; or mixtures thereof, by any suitable method.

The lubricating oil composition of the present invention contains Component (C) in an amount of 0.3 to 0.5 percent by mass and preferably 0.3 to 0.4 percent by mass in terms of sulfur on the basis of the total mass of the composition. Component (C) of less than 0.3 percent by mass is not preferable because the resulting composition will be poor in anti-seizure properties for shift forks while Component (C) in excess of 0.5 percent by mass is not also preferable because the resulting composition will fail to provide sufficient shifting characteristics and rust or strong acid causing corrosion will be likely to be produced when the composition is deteriorated. When two or more selected from the above-described (C-1) to (C-5) components are used in combination, the content of each component is from 0.01 to 0.49 percent by mass, preferably from 0.05 to 0.45 percent by mass, and particularly preferably 0.1 to 0.4 percent by mass in terms of sulfur. The content of (C-4) dihydrocarbyl polysulfide compounds in particular is preferably from 0.01 to 0.2 percent by mass and more preferably 0.02 to 0.15 percent by mass, while the content of (C-5) sulfurized ester compounds is preferably from 0.1 to 0.4 percent by mass and more preferably from 0.2 to 0.3 percent by mass.

Specific examples of (D) an alkyl phosphite (hereinafter also referred to as "Component (D)") of the lubricating oil composition of the present invention include monophosphites, diphosphites, triphosphites, salts of phosphites, each having a hydrocarbon group having 2 to 30 and preferably 3 to 20 carbon atoms, and mixtures thereof.

Specific examples of the hydrocarbon group having 2 to 30 carbon atoms include straight-chain or branched alkyl groups such as ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups; straight-chain or branched alkenyl groups such as butenyl, pentenyl, hexenyl, heptenyl, octenyl, noneyl, decenyl, undecenyl, dodecenyl, tridecenyl, tetradecenyl, pentadecenyl, hexadecenyl, heptadecenyl, and octadecenyl groups, the position of which the double bonds may vary; cycloalkyl groups having 5 to 7 carbon atoms, such as cyclopentyl, cyclohexyl, and cycloheptyl groups; alkylcycloalkyl groups having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups, of which the alkyl groups may bond to any position of the cycloalkyl groups; aryl groups such as phenyl and naphtyl groups; alkylaryl groups having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups; and arylalkyl groups having 7 to 12 carbon atoms, such as benzyl, phenylethyl, phenylpropyl, phenylbutyl, phenylpentyl, and phenylhexyl groups, of which the alkyl groups may be straight-chain or branched.

Preferred compounds for Component (D) include monoalkyl phosphites such as monopropyl phosphite, monobutyl phosphite, monopentyl phosphite, monohexyl phosphite, monoheptyl phosphite, and monooctyl phosphite, of which the alkyl groups may be straight-chain or branched; mono(alkyl)aryl phosphites such as monophenyl phosphite and monocresyl phosphite, of which the alkyl groups may be straight-chain or branched; dialkyl phosphites such as dipropyl phosphite, dibutyl phosphite, dipentyl phosphite, dihexyl phosphite, diheptyl phosphite, and dioctyl phosphite, of which the alkyl groups may be straight-chain or branched; di(alkyl)aryl phosphites such as diphenyl phosphite and dicresyl phosphite; trialkyl phosphites such as tripropyl phosphite, tributyl phosphite, tripentyl phosphite, trihexyl phosphite, triheptyl phosphite, and trioctyl phosphite, of which the alkyl groups may be straight-chain or branched; tri(alkyl)aryl phosphites such as triphenyl phosphite and tricresyl phosphite; and mixtures thereof.

Specific examples of the aforesaid salts of phosphites include those produced by allowing a nitrogen-containing compound such as ammonia and an amine compound having in its molecules only a hydrocarbon group having 1 to 8 carbon atoms or a hydroxyl group-containing hydrocarbon group having 1 to 8 carbon atoms to react with a monophosphite or a diphosphite so as to neutralize the whole or part of the remaining acid hydrogen.

Specific examples of nitrogen compounds include ammonia, alkylamines, of which the alkyl groups may be straight-chain or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylaamine, ethylbutylamine, propylbutylamine, dibutylamine, dipentylamine, dihexylamine, diheptylamine and dioctylamine; alkanolamines, of which the alkanol groups may be straight-chain or branched, such as monomethanolamine, monoethanolamine, monopropanolamine, monobutanolamine, monopentanolamine, monohexanolamine, monoheptanolamine, monooctanolamine, monononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

One or more of the aforesaid Components (D) may be arbitrary blended in the lubricating oil composition of the present invention.

The lubricating oil composition of the present invention contains Component (D) in an amount of 0.02 to 0.05 percent by mass, preferably 0.025 to 0.045 percent by mass, and particularly preferably 0.03 to 0.045 percent by mass, in terms of phosphorus on the basis of the total mass of the composition. Component (D) of less than 0.02 percent by mass in terms of phosphorus is not preferable because synchronizer rings undergo stick torque while Component (D) in excess of 0.05 percent by mass is not also preferable because the resulting composition will be poor in oxidation stability.

The present invention can provide a lubricating oil composition for manual transmissions having excellent anti-seizure properties and providing the transmissions with excellent shifting characteristics, by blending a lubricating base oil with the above-described Components (A) to (D) in specific amounts. However, in order to further enhance the various properties of the lubricating oil composition, there may be used known lubricant additives such as ashless dispersants, metallic detergents other than Component (A), friction modifiers, extreme pressure additives and anti-wear agents other than Component (C), rust inhibitors, corrosion inhibitors, viscosity index improvers, pour point depressants, rubber swelling agents, anti-foaming agents, and dyes alone or in combination.

Ashless dispersants which may be used in combination with the lubricating oil composition may be any compound that is generally used as an ashless dispersant for lubricating oils. Examples of such an ashless dispersant include nitrogen-containing compounds having at least one alkyl or alkenyl group having 40 to 400 carbon atoms in the molecules and derivatives thereof, and modified products of alkenyl succinimides.

The alkyl or alkenyl group may be straight-chain or branched but is preferably a branched alkyl or alkenyl group derived from an oligomer of an olefin such as propylene, 1-butene, and isobutylene or from a cooligomer of ethylene and propylene.

The carbon number of the alkyl or alkenyl group is preferably from 40 to 400 and preferably from 60 to 350. An alkyl or alkenyl group having fewer than 40 carbon atoms would deteriorate the solubility of the compound in a lubricating base oil, while an alkyl or alkenyl group having more than 400 carbon atoms would deteriorate the low-temperature fluidity of the resulting lubricating oil composition.

Specific examples of the derivatives of the nitrogen-containing compounds exemplified as an example of ashless dispersants include an acid-modified compound produced by allowing any of the above-described nitrogen-containing compounds to react with a monocarboxylic acid having 2 to 30 carbon atoms, such as fatty acid or a polycarboxylic acid having 2 to 30 carbon atoms, such as oxalic acid, phthalic acid, trimellitic acid, and pyromellitic acid, so as to neutralize or amidize the whole or part of the remaining amino and/or imino groups; a boron-modified compound produced by allowing any of the above-described nitrogen-containing compounds to react with boric acid so as to neutralize or amidize the whole or part of the remaining amino and/or imino groups; a sulfur-modified compound produced by allowing any of the above-described nitrogen-containing compounds to react with a sulfuric compound; and modified products produced by a combination of two or more selected from the modifications with acid, boron, and sulfur, of the above-described nitrogen-containing compounds.

The lubricating oil composition may contain any one or more of these ashless dispersants in any amount. However, the content is usually from 0.1 to 10 percent by mass on the basis of the total mass of the composition.

Metallic detergents other than Component (A) which may be used in combination with the lubricating oil composition may be any compound that is generally used as a metallic detergent for lubricating oils. Examples of such a metallic detergent include alkali metal or alkaline earth metal sulfonates other than Component (A), alkali metal or alkaline earth metal phenates, alkali metal or alkaline earth metal salicylates, and alkali metal or alkaline earth metal naphthenates. These metallic detergents may be used alone or in combination. Preferred alkali metals include sodium and potassium, while preferred alkaline earth metals include calcium.

Specific examples of metallic detergents other than component (A) include sulfonates, phenates and salicylates of calcium. The base number and content of these metallic detergents may be arbitrarily selected depending on the properties of a lubricating oil to be required.

Examples of friction modifiers include organic metallic friction modifiers such as molybdenum dithiophosphate and molybdenum dithiocarbamate and ashless friction modifiers such as aliphatic monohydric alcohols, fatty acids or derivatives thereof, and aliphatic amines or derivatives thereof, each having at least one alkyl or alkenyl group having 6 to 30 carbon atoms.

Examples of extreme pressure additives and anti-wear agents other than Component (C) include disulfides, olefin sulfides, sulfurized fats and oils, and zinc dithiophosphate other than Component (B).

Examples of rust inhibitors include alkenyl succinic acid, alkenyl succinic acid esters, polyhydric alcohol esters, petroleum sulfonates, and dinonylnaphthalene sulfonates.

Examples of corrosion inhibitors include benzotriazole-, thiadiazole-, and imidazole-based compounds.

Examples of viscosity index improvers include polymethacrylates, olefin copolymers such as ethylene-propylene copolymers or hydrides thereof, styrene-diene copolymers, graft copolymers of polymethacrylates and olefin copolymers or hydrides thereof.

Examples of pour point depressants include polymers such as polyacrylates and polymethacrylates compatible with a lubricating oil base oil to be used.

Examples of anti-foaming agents include silicones such as dimethylsilicone and fluorosilicone.

Although the contents of these additives are arbitrarily selected, the content of the anti-foaming agent is generally from 0.0005 to 1 percent by mass, the content of the corrosion inhibitor is generally from 0.005 to 1 percent by mass, and the content of each of the other additives is generally from 0.05 to 15 percent by mass, all on the basis of the total mass of the composition.

The lubricating oil composition of the present invention has necessarily a kinematic viscosity at 40° C. of 25 to 30 $mm^2/s$ and preferably 27 to 30 $mm^2/s$.

The lubricating oil composition having a kinematic viscosity at 40° C. of 25 $mm^2/s$ or greater is more excellent in oil film forming capability and lubricity and less in evaporation loss of the base oil at elevated temperatures. The lubricating oil composition having a kinematic viscosity at 40° C. of 30 $mm^2/s$ or less is less in friction resistance (friction loss) at lubricating sites and stirring resistance due to its reduced fluid resistance.

There is no particular restriction on the kinematic viscosity at 100° C. of the lubricating oil composition. However, the kinematic viscosity at 100° C. is preferably 4.8 $mm^2/s$ or greater and more preferably 5.2 $mm^2/s$ or greater with the objectives of excellent oil film forming capability and lubricity and less evaporation loss of the base oil at elevated temperatures. The kinematic viscosity at 100° C. is also preferably 6.0 $mm^2/s$ or less with the objectives of less fluid resistance leading to less friction resistance (friction loss) at lubricating sites and less stirring resistance.

Although the lubricating oil composition for manual transmissions of the present invention has a low viscosity, it is excellent in anti-seizure properties for shift forks and can allow the transmissions to exhibit excellent shifting characteristics and achieve fuel saving for automobiles.

Hereinafter, the present invention will be described in more details by way of the following examples and comparative examples, which should not be construed as limiting the scope of the invention.

Examples 1 to 3 and Comparative Examples 1 to 10

Lubricating oil compositions for manual transmissions according to the present invention (Examples 1 to 3) were prepared in accordance with the formulations set forth in Table 1 below. These lubricating oil compositions were subjected to performance evaluating tests described below, and the results are also set forth in Table 1.

Lubricating oil compositions for manual transmissions for comparison (Comparative Examples 1 to 10) were also prepared in accordance with the formulations set forth in Table 2 below. These lubricating oil compositions were also subjected to the same performance evaluating tests, and the results are also set forth in Table 2.

[Shift Fork Seizure Test]

Using a real manual transmission, each of the compositions was evaluated in anti-seizure properties between a shift fork and a sleeve by applying a load on the shift fork with the shift lever. The test conditions are given below. The anti-seizure properties were determined through changes in oil temperature, and the load at which the oil temperature was rapidly increased was regarded as seizuring load. If the load applied with the shift lever was 200 N or greater, it is recognized that there is no problems in practical use.

Engine speed: 6750 rpm

Oil temperature: 115° C.

Gear: 3rd speed gear

Method of load increasing: each load was applied for one hour, and increased by 10 N

[Synchronizer Friction Evaluation Test]

Each of the compositions was evaluated in friction properties using a test machine wherein a synchronizer ring was arranged in alignment with a gear cone which can be rotated with a motor. This machine can measure the torque generated when the synchronizer ring was pressed against the gear cone while rotating. The pressing was repeated 500 times under the conditions given below. Then, the friction coefficient measured when the synchronizer ring was rotated at 200 rpm was defined as "$\mu_d$". The torque generated on the synchronizer ring when the rotation of the gear cone was initiated for the next pressing is defined as "stick torque". If the $\mu_d$ is 0.10 or greater, the composition is regarded as being excellent in shifting characteristics. A composition causing the generation of stick torque was evaluated as "poor", while a composition not causing the generation of stick torque was excellent in friction properties and thus evaluated as "excellent".

Oil temperature: 80° C.

Gear cone speed: 300 rpm

Inertia: 0.05 kg·m$^2$

Load: 500 N

As apparent from the results set forth in Tables 1 and 2, the lubricating oil compositions of Examples 1 to 3 for manual transmissions according to the present invention had significantly excellent anti-seizure properties and shifting characteristics.

Whereas, Comparative Example 1 with less Component (A), Comparative Example 2 with no Component (A), Comparative Example 3 with less Component (B), Comparative Example 4 with too much Component (B), Comparative Example 5 with Component (B) of different structure, Comparative Example 6 with less Component (C), Comparative Example with too much Component (C), Comparative Example 8 with less Component (D), Comparative Example 9 with Component (D) of different structure, and Comparative Example 10 with smaller kinematic viscosities of the base oil and the composition were all poorer in anti-seizure properties and shifting characteristics, than the lubricating oil compositions of the present invention.

TABLE 1

Table 1

| | Example 1 | Example 2 | Example 3 |
|---|---|---|---|
| Base oil-A(1) | 94.5 | 94.6 | |
| Base oil-B(2) | | | 94.5 |
| (A) Magnesium sulfonate-A(3) | 1.9 | 1.9 | 1.9 |
| Amount of magnesium mass % | 0.18 | 0.18 | 0.18 |
| (B) Zinc dithiophosphate-A(4) | 1.4 | 1.4 | 1.4 |
| Amount of zinc mass % | 0.16 | 0.16 | 0.16 |
| (C) Sulfurized ester(5) | 1 | 0.5 | 1 |
| (C) Polysulfide(6) | 0.6 | 1 | 0.6 |
| Total amount of sulfur mass % | 0.34 | 0.45 | 0.34 |
| (D) Phosphite(7) | 0.0 | 0.6 | 0.6 |
| Amount of phosphorus mass % | 0.04 | 0.04 | 0.04 |
| Kinematic viscosity (40° C.) mm$^2$/s | 29 | 29 | 29 |
| Shift fork seizuring load N | 250 | 240 | 250 |
| Friction properties | | | |
| μd | 0.10 | 0.10 | 0.10 |
| Stick torque | Excellent | Excellent | Excellent |

(1)Hydrorefined mineral oil (100° C. kinematic viscosity 5 mm$^2$/s, Viscosity index 120)

(2)Solvent-refined mineral oil (100° C. kinematic viscosity 5 mm$^2$/s, Viscosity index 95)

(3)Magnesium sulfonate (Base number 300 mgKOH/g, magnesium content 9.5 mass %)

(4)Zinc dithiophosphate (Alkyl group: $C_3$ or $C_0$ secondary alkyl group, zinc content 11.2 mass %)

(5)Sulfurized ester (Sulfur content 10 mass %)

(6)dihydrocarbyl polysulfide (Sulfur content 40 mass %)

(7)Alkylphosphite (Phosphorus content 6 mass %)

TABLE 2

Table 2

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|
| Base oil-A(1) | 95.1 | 95.0 | 94.9 | 94.1 | 54.5 | 95.1 | 93.1 | 95.0 | 94.9 | |
| Base oil-C(1( | | | | | | | | | | 94.9 |
| (A) Magnesium sulfonate-A(3) | 1.3 | | 1.9 | 1.9 | 1.9 | 1.9 | 1.9 | 1.9 | 1.9 | 1.9 |
| Amount of magnesium mass % | 0.12 | | 0.18 | 0.18 | 0.16 | 0.16 | 0.18 | 0.18 | 0.18 | 0.18 |
| Calcium sulfonate-A(9) | | 1.4 | | | | | | | | |
| (B) Zinc dithiophosphate-A(4) | 1.4 | 1.4 | 1 | 1.8 | | 1.4 | 1.4 | 1.4 | 1.4 | 1.4 |
| Amount of zinc mass % | 0.16 | 0.18 | 0.11 | 0.20 | | 0.16 | 0.16 | 0.16 | 0.16 | 0.16 |
| Zinc dithiophosphate-B(10) | | | | | 1.4 | | | | | |
| (C) Sulfurized ester(5) | 1 | 1 | 1 | 1 | 1 | 0.6 | 2 | 1 | 1 | 1 |
| (C) Polysulfide(6) | 0.6 | 0.6 | 0.6 | 0.6 | 0.6 | 0.4 | 1 | 0.6 | 0.6 | 0.6 |
| Total amount of sulfur mass % | 0.34 | 0.34 | 0.34 | 0.34 | 0.34 | 0.22 | 0.6 | 0.34 | 0.34 | 0.34 |
| (D) Phosphite(7) | 0.6 | 0.6 | 0.6 | 0.6 | 0.6 | 0.6 | 0.8 | 0.1 | | 0.6 |
| Amount of phosphorus mass % | 0.04 | 0.04 | 0.04 | 0.04 | 0.04 | 0.04 | 0.04 | 0.01 | | 0.04 |
| Phosphate(11) | | | | | | | | | 0.2 | |
| Kinematic viscosity (40° C.) mm$^2$/s | 29.00 | 29.00 | 29.00 | 25 | 29 | 29 | 29 | 20 | 20 | 23 |
| Shift fork seizuring load N | 230 | 210 | 140 | 140 | 140 | 120 | 250 | 250 | 250 | 120 |

TABLE 2-continued

Table 2

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|
| Friction properties | | | | | | | | | | |
| μd | 0.00 | 0.06 | 0.10 | 0.10 | 0.10 | 0.10 | 0.07 | 0.10 | 0.10 | 0.10 |
| Stick torque | Excellent | Excellent | Excellent | Excellent | Excellent | Excellent | Excellent | Poor | Poor | Excellent |

(1)Hydrorefined mineral oil (100° C. kinematic viscosity 5 $mm^2/s$, Viscosity index 120)
(3)Magnesium sulfonate (Base number 300 mgKOH/g, magnesium content 9.5 mass %)
(4)Zinc dithiophosphate (Alkyl group: $C_3$ or $C_0$ secondary alkyl group, zinc content: 11.2 mass %)
(5)Sulfurized ester (Sulfur content 10 mass %)
(6)dihydrocarbyl polysulfide (Sulfur content 40 mass %)
(7)Alkylphosphite (Phosphorus content 6 mass %)
(8)Hydrorefined mineral oil (100° C. kinematic viscosity 3 $mm^2/s$, Viscosity index 120)
(9)Calcium sulfonate (Base number 300 mgKOH/g, calcium content 12.0 mass %)
(10)Zinc dithiophosphate (Alkyl group: $C_3$ primary alkyl group, zinc content 7.0 mass %)
(11)Alkylphosphate (Phosphorus content 12.0 mass %)

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A lubricating oil composition for manual transmissions, comprising a lubricating base oil with a kinematic viscosity at 100° C. of 4 to 6 $mm^2/s$, on the basis of the total mass of the composition, (A) 0.14 to 0.20 percent by mass in terms of magnesium of magnesium sulfonate, (B) 0.14 to 0.18 percent by mass in terms of zinc of zinc dithiophosphate represented by formula (I) below, (C) 0.3 to 0.5 percent by mass in terms of sulfur of a sulfur-containing extreme pressure additive other than zinc dithiophosphate which comprises (C-4) dihydrocarbyl polysulfide compounds and at least one compound selected from the group consisting of (C-1) thiazole compounds, (C-2) thiadiazole compounds. (C-3) dithiocarbamate compounds, and (C-5) sulfurized ester compounds, and (D) 0.02 to 0.05 percent by mass in terms of phosphorus of an alkyl phosphite, and having a kinematic viscosity at 40° C. of 25 to 30 $mm^2/s$:

(1)

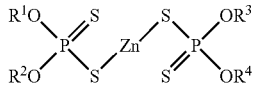

wherein $R^1$ to $R^4$ are each a secondary alkyl group having 3 or 6 carbon atoms.

2. A lubricating oil composition for manual transmissions, comprising a lubricating base oil with a kinematic viscosity at 100° C. of 4 to 6 $mm^2/s$, on the basis of the total mass of the composition, (A) 0.14 to 0.20 percent by mass in terms of magnesium of magnesium sulfonate, (B) 0.14 to 0.18 percent by mass in terms of zinc of zinc dithiophosphate represented by formula (1) below, (C) 0.3 to 0.5 percent by mass in terms of sulfur of a sulfur-containing extreme pressure additive other than zinc dithiophosphate which comprises (C-4) dihydrocarbyl polysulfide compounds and at least one compound selected from the group consisting of (C-1) thiazole compounds, (C-2) thiadiazole compounds, (C-3) dithiocarbamate compounds and (C-5) sulfurized ester compounds, and (D) 0.02 to 0.05 percent by mass in terms of phosphorus of an alkyl phosphite; and having a kinematic viscosity at 100° C. of 4.8 to 6 $mm^2/s$:

(1)

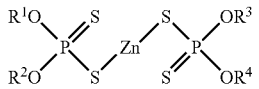

wherein $R^1$ to $R^4$ are each a secondary alkyl group having 3 or 6 carbon atoms.

3. The lubricating oil composition according to claim 1, wherein the sulfur-containing extreme-pressure additive comprises (C-4) dihydrocarbyl polysulfide compounds and (C-5) sulfurized ester compounds.

4. The lubricating oil composition according to claim 2, wherein the sulfur-containing extreme-pressure additive comprises (C-4) dihydrocarbyl polysulfide compounds and (C-5) sulfurized ester compounds.

5. The lubricating oil composition according to claim 1, wherein the content of the zinc dithiophosphate is from 0.16 to 0.18 percent by mass in terms of zinc based on the total mass of the composition.

6. The lubricating oil composition according to claim 2, wherein the content of the zinc dithiophosphate is from 0.16 to 0.18 percent by mass in terms of zinc based on the total mass of the composition.

7. A lubricating oil composition for manual transmissions, comprising a lubricating base oil with a kinematic viscosity at 100° C. of 4 to 6 $mm^2/s$, on the basis of the total mass of the composition, (A) 0.14 to 0.20 percent by mass in terms of magnesium of magnesium sulfonate, (B) 0.16 to 0.18 percent by mass in terms of zinc of zinc dithiophosphate represented by formula (1) below, (C) 0.3 to 0.5 percent by mass in terms of sulfur of a sulfur-containing extreme pressure additive other than zinc dithiophosphate which comprises (C-4) dihydrocarbyl polysulfide compounds and at least one compound selected from the group consisting of (C-1) thiazole compounds, (C-2) thiadiazole compounds, (C-3) dithiocarbamate compounds, and (C-5) sulfurized ester compounds, and (D) 0.02 to 0.05 percent by mass in terms of phosphorus of an alkyl phosphite, and having a kinematic viscosity at 40° C. of 25 to 30 $mm^2/s$ or a kinematic viscosity at 100° C. of 4.8 to 6 $mm^2/s$:
(1)
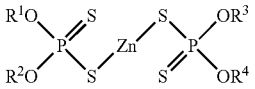
wherein $R^1$ to $R^4$ are each a secondary alkyl group having 3 or 6 carbon atoms.
* * * * *